US005191673A

United States Patent [19]

Damizet

[11] Patent Number: 5,191,673

[45] Date of Patent: Mar. 9, 1993

[54] REMOTE CONTROL DEVICE VACUUM OR VENTILATION SYSTEM

[75] Inventor: Patrick Damizet, Venissieux, France

[73] Assignees: Aldes Aeraulique; Societe d'Etudes et de Recherche de Ventilation et d'Aeraulique S.E.R.V.A., Bussy Saint Georges, France

[21] Appl. No.: 527,372

[22] Filed: May 23, 1990

[30] Foreign Application Priority Data

May 23, 1989 [FR] France ..... 89 06974

[51] Int. Cl.[5] ..... A47L 5/38

[52] U.S. Cl. ..... 15/314; 15/319

[58] Field of Search ..... 15/301, 314, 319

[56] References Cited

U.S. PATENT DOCUMENTS

| | | | |
|---|---|---|---|
| 1,106,231 | 8/1914 | Marshall | 15/314 |
| 2,979,755 | 4/1961 | McCaskill | 15/314 |
| 3,083,396 | 4/1963 | Senne et al. | 15/319 |
| 3,669,145 | 6/1972 | Holstrom | 137/567 |
| 3,873,790 | 3/1975 | Coons | 15/DIG. 10 |
| 4,225,272 | 9/1980 | Palmovist | 406/15 |
| 4,829,626 | 5/1989 | Härkönen et al. | 15/314 |

FOREIGN PATENT DOCUMENTS

| | | |
|---|---|---|
| 156011 | 10/1985 | European Pat. Off. . |
| WO8802232 | 4/1988 | PCT Int'l Appl. . |
| 26660 | of 1913 | United Kingdom . |
| 2015652 | 9/1979 | United Kingdom . |

*Primary Examiner*—Chris K. Moore

*Attorney, Agent, or Firm*—Oliff & Berridge

[57] ABSTRACT

This device has a housing 2, a motorized vacuum turbine 4 pneumatically connected to outlet 2b of a housing, and at least one tube 6 whose downstream end 6a terminates in housing 2, and structure 13, 40 connected to upstream end 6b of tube 6 capable of generating a temporary pneumatic pressure wave in the direction of its downstream end 6a. The latter is associated with structure 20, 22 for detecting the pressure wave and acting on module 23 for controlling the power to electric motor 3 of vacuum turbine 4 to start the system operating. The pneumatic pressure wave is conveyed by tube 6 itself from its upstream end 6b to its downstream end 6a, this downstream end being provided with a shutoff flap 18, normally held in the closed position and capable of causing the tube to be opened under the influence of the vacuum flow.

24 Claims, 3 Drawing Sheets

REMOTE CONTROL DEVICE VACUUM OR VENTILATION SYSTEM

TECHNICAL FIELD

The invention relates to vacuum or ventilation systems comprising a vacuum housing, a motorized vacuum turbine connected pneumatically to the outlet of said housing, and at least one tube, one of whose ends terminates in the housing. A structure of this kind is used in central vacuum systems, on vacuum cleaners of the portable or canister type, in mechanical ventilation systems, and also in certain so-called dry columns or fume hoods. To simplify the description, reference will be made to central vacuum systems, but it is obvious that the invention applies to any systems comprising at least one tube one of whose ends is connected to a vacuum or ventilation assembly.

BACKGROUND

In such centralized vacuum systems, the vacuum assembly together with its dust reservoir is located in a utility area and the tube terminating in the housing is part of a network of tubes connecting the central power unit to wall valves located in the areas to be cleaned. Each wall valve is sealed by a hinged lid and receives the rear nozzle of a hose whose front nozzle, equipped with a handle, receives a rigid wand or cleaning tool.

In the majority of current systems, the central power unit is turned on and off by microcontacts located in each wall valve and by a low-voltage electrical circuit connecting each wall valve to the power unit. Thus, when the user inserts the rear nozzle of the vacuum hose into a wall valve, the power to the electric motor in the power unit is turned on; withdrawing the nozzle cuts off the power.

The low-voltage electrical circuit is either mounted next to the vacuum tubes or installed inside these tubes, and always requires a long installation time, to which is added the time required to hook up the wall valves and to check the electrical connections. Consequently, this control mode results in a rather high installation cost, plus the cost of the electrical equipment that must be installed, comprising a transformer, relays at the power unit, and the various contacts in the wall valves. Another disadvantage of this type of control arises from the necessity to unplug the hose to open the control circuit and stop the power unit. In addition, several types of systems are known comprising a start-stop button on the hose handle, with electrical conductors as an integral element of the hose. Hoses of this kind are little used, however, because they are heavier and even more awkward than traditional ones. The same remote control method for operating the vacuum assembly is provided on certain portable vacuum cleaners. Here again, it has resulted in significant extra expense and increased weight.

Documents U.S. Pat. No. 3,669,145 and GB-A-2 015 652 each describe a centralized vacuum system comprising a main vacuum turbine and a system furnishing a secondary vacuum when the turbine is not operating. Opening a switch valve on a vacuum hose in the system changes the negative pressure to supply pneumatic information causing the main vacuum turbine to operate.

Document EP-A-0 156 011 relates to a control device for a portable vacuum cleaner, especially by action on the handle of a dust vacuum hose. This device comprises a small duct parallel to the main hose and serving to carry a pneumatic pressure wave from the handle to the vacuum assembly, causing the turbine to start if it is stopped, or to stop if it is running. In addition, negative pressure waves transmitted through the small duct from the handle enable the vacuum level to be adjusted. In view of its complexity, a control device of this kind is not applicable to a central vacuum or ventilation system.

SUMMARY OF THE INVENTION

The goal of the present invention is to overcome these disadvantages by furnishing a remote-control device for starting and stopping a vacuum or ventilation system, said device, by simplifying installation of the tube or tubes and the structure of the hose, being simple, reliable, less cumbersome, and safe for the user.

To this end, the device according to the invention is of the type comprising a housing, a motorized vacuum turbine connected pneumatically to an outlet in the housing, and at least one tube whose downstream end terminates in the housing means connected to the upstream end of the tube are capable of generating a single pneumatic pressure through the timer of the tube toward the downstream end of said tube. The latter is associated with means for detecting the pressure pulse and acting on the electric motor power supply control module of the vacuum turbine to start the system. The pneumatic pressure pulse is conveyed by the tube itself from its upstream end to its downstream end, and the downstream end is provided with a shutoff flap, normally held in the closed position and capable of opening under the influence of negative vacuum pressure. Thus, the power is connected to the electric motor of the turbine and the system is started by a pressure pulse generated upstream of the housing and reaching said housing through the tube or network of tubes. This pressure pulse does not require means other than those required for operation of the system itself and consequently constitutes a control means with very little influence on system cost.

Advantageously, the device also comprises means to interrupt the vacuum flow in the tube and stop the system, as well as means located near the housing to detect the absence of vacuum flow in the tube and exercise control, with a time delay, by opening the electrical circuit powering the motor.

In one embodiment of the invention, the means to generate the pressure pulse comprises a piston slidably mounted in the end of the body of the handle between a forward stop position and a rear operating position, located in the rear of the front tubular nozzle of the handle, while the detection means comprises a pressure sensor connected electrically to the motor control circuit and pneumatically to the section of vacuum tube connected to the vacuum housing.

To start the vacuum power unit by means of this device, it is merely necessary to shift the nozzle relative to the handle so that as a result of this displacement, the air contained in the body of the handle is expelled toward the power unit, creating a single pressure pulse whose detection by the pressure sensor turns on the power to the turbine electric motor.

BRIEF DESCRIPTION OF THE DRAWINGS

Other characteristics and advantages will be evident from the following description with reference to the attached schematic diagrams, showing as nonlimiting examples a plurality of embodiments of this device as applied to a central vacuum system.

DETAILED DESCRIPTION OF PREFERRED EMBODIMENTS

Figure 1:
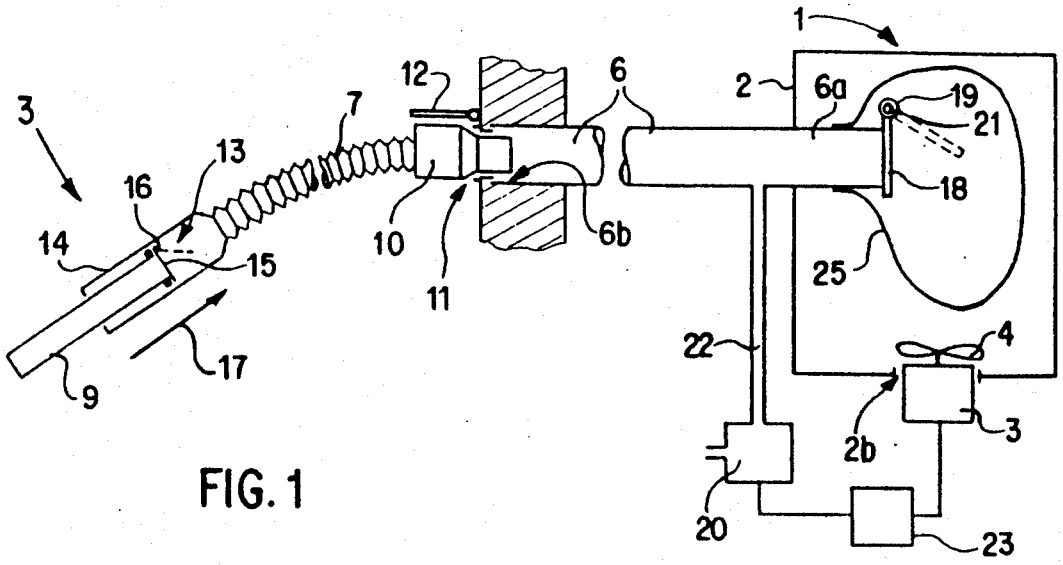
FIG. 1 is a schematic side view in partial cross section showing a first embodiment of the device according to the invention.

In the drawings, 2 designates the housing of a vacuum power unit 1, 3 designates the electric motor, turbine 4 creates the vacuum in housing 6*a*, with the downstream end terminating in the housing of a network of tubes 6 connected at their upstream ends 6*b* to wall valves distributed around the building, and 7 is a hose. The forward end of hose 7 is provided with a handle 8 with a forward tubular nozzle 9 for attaching vacuum tools, with or without a wand. Its rear is provided with a nozzle 10 connectable to any one of wall valves 11. 12 represents a shutoff flap associated with each of wall valves 11 and capable of sealing said wall valve tightly when nozzle 10 of hose 7 is not connected to said wall valve.

According to the invention, this system is provided with a remote control device to stop or start the power unit and acting on the means controlling the power supply to electric motor 3. The embodiments shown with reference to FIGS. 1 to 11 show, as control means for triggering, a pneumatic pressure pulse generated in handle 8, and, for stopping, a change in the vacuum flow, both being detected near power unit 1.

In the embodiment shown in FIG. 1, this pressure pulse is produced by a piston 13 provided at the rear of nozzle 9 and slidably mounted within the body of handle 14. More specifically, this piston is formed by a flap 15 articulated at 16 on the rear of nozzle 9.

It will be easily understood that by suddenly displacing nozzle 9 in the direction of arrow 17 in body 14 of handle 8, flap 15 remains on the end of the nozzle, forms a piston, and pushes the air ahead of it, creating a pressure pulse. This pulse, travelling through hose 7 and then through tubes 6, arrives at end 6*a* of the tube terminating in housing 2 of power unit 1. As FIG. 1 shows, downstream end 6*a* of the tube is blocked by a flap 18 articulated at 19 and associated with a blocking spring 21 calibrated to allow flap 18 to rise under the influence of the operating vacuum of housing 2.

Because of this flap 18, the pressure pulse is not weakened in housing 2 and can be detected perfectly by a sensitive pressure sensor 20, connected by a tube 22 to end 6*a* of tube 6. This pressure sensor is electrically connected to control module 23 for electric motor 3.

Thus, the pressure pulse created in the handle is detected at the other end of the network of tubes 6 and detected by pressure sensor 20, said sensor controlling the power to electric motor 3 through module 23. When the motor is energized, turbine 4 generates a vacuum in housing 2, said vacuum raising flap 18, as shown by the dot-dashed lines in FIG. 1, as well as flap 15 located in handle 8, thus allowing the system to function normally.

Figure 2:
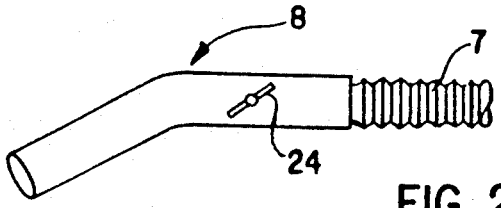
FIG. 2 is a partial view of the forward nozzle of the hose, showing one embodiment of the means for shutting off the vacuum power unit.

The system is shut off when an absence of flow in hose 7 and in the network of tubes 6 is detected. One embodiment is shown in FIG. 2. In this case, handle 8 is provided internally with an articulated flap or sealing butterfly valve 24, said valve occupying one position in which it allows all of the vacuum flow to pass or a second position in which it completely blocks the internal cross section of handle 9. This butterfly valve is controlled from the outside of the handle by a button, not shown. Closing this butterfly valve cuts off the vacuum flow, increasing the vacuum in housing 2. As will be described in greater detail below, this increase in vacuum is detected by suitable means, said means acting on control module 23 to cut off the power to motor 3. To prevent the motor from stopping as a result of a temporary obstruction of the vacuum, for example by inadvertent blockage of the vacuum tool attached to the end of nozzle 9, the vacuum detection means in chamber 2 are associated with a timer which will not cut off the electricity powering motor 3 until a certain time has elapsed.

Figure 5:
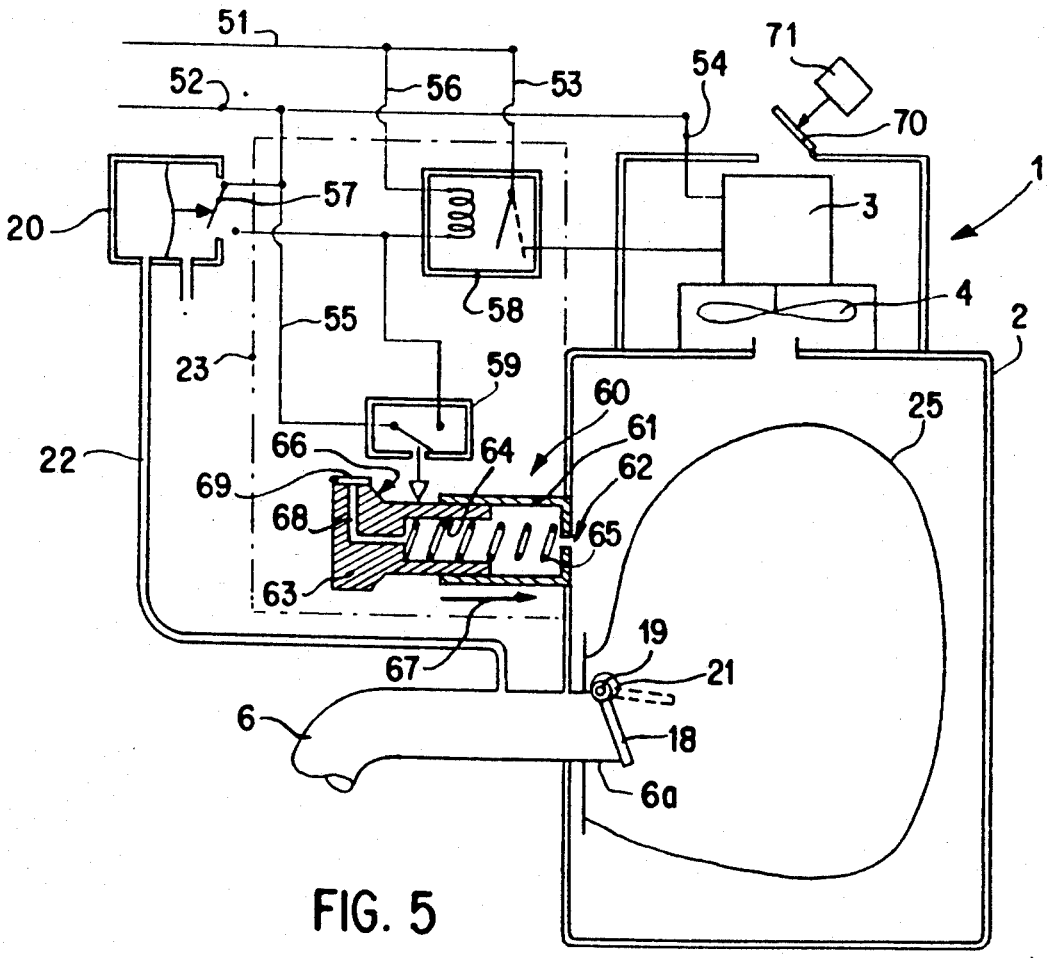
FIG. 5 is a schematic side view in cross section of the power unit, also showing one embodiment of the means for controlling the drive motor power.

It should be pointed out that means for detecting an increase in the vacuum in the housing to cut off the power to motor 3 make it possible to initiate the stopping process by means other than those mounted in handle 8. Thus, these means can be composed of flap 12 associated with each wall valve 11, said flap sealing off the wall valve when rear nozzle 10 of the hose is pulled out of said valve. Shutoff can also be triggered by deliberate blockage of any one of the tubes or of the hose by obstructing it with the hand, or by clogging of filter 25 mounted on the downstream end 6*a* of the network of tubes, as shown in FIGS. 1 and 5.

Figure 3:
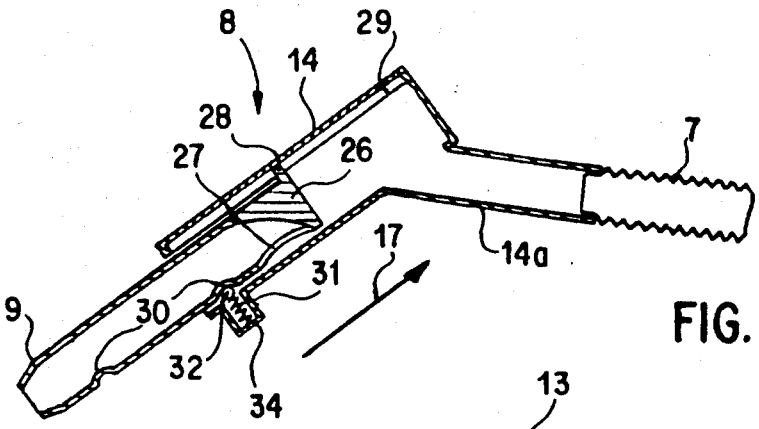
FIGS. 3 and 4 are partial side views in cross section, showing another embodiment of the handle in the stop and start positions, respectively.
Figure 4:
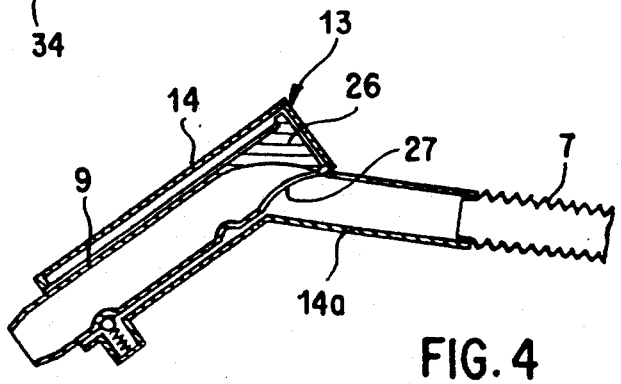

In the embodiment shown in FIGS. 3 and 4, piston 13 mounted on the rear of nozzle 9 and slidably mounted in tubular body 14 of handle 8 is composed of a plug 26 formed at the rear of the handle and adjacent to an opening 27 in said nozzle. Nozzle 9 is wedged relative to body 14, for example by a finger 28 sliding in a groove 29 in the body, and is provided with at least one catch 30 to lock it in a stop position, cooperating with elastic means. In the embodiment shown, these means are composed of a ball 32 arranged with its spring 31 in a recess 34 in the body of the handle.

With this arrangement, when the user wants to start the system, the resistance offered by the lock forces him to exert a greater effort on nozzle 9. When catch 30 is released from the lock, nozzle 9 is suddenly displaced in the direction of arrow 17, thus permitting plug 26, constituting a piston, to expel the air in tubular body 14 and then through connection 14*a* into flexible hose 7. At the end of the movement as shown in FIG. 4, opening 27 coincides with the termination of connection 14*a* in body 14, thus permitting nozzle 9 to communicate with the vacuum flow coming from hose 7.

To shut off the system with this device, it is sufficient to bring the nozzle into its shutoff position with piston 26 constituting a blocking means and opposing the passage of the vacuum flow, causing the system to shut off.

Figure 6:
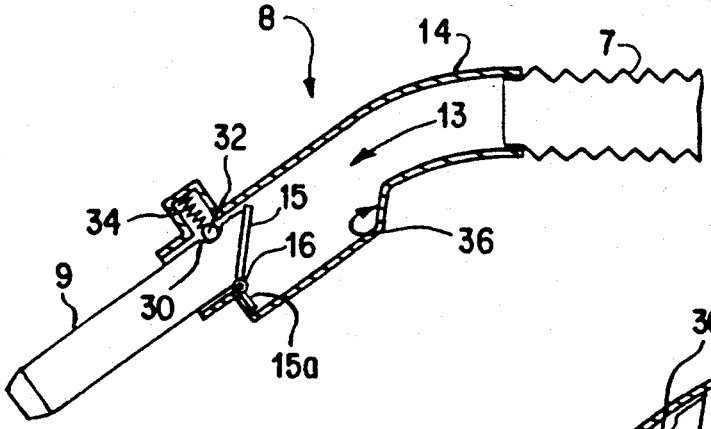
FIGS. 6 and 7 are partial side views in cross section showing one embodiment.of the handle in the stop and start positions, respectively.
Figure 7:
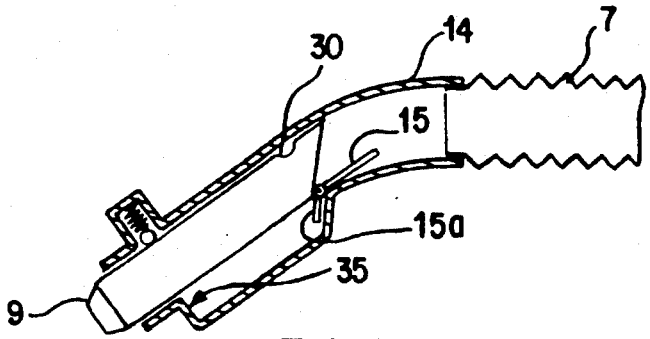

The embodiment shown in FIGS. 6 and 7 differs from that in FIGS. 3 and 4 in that flap 15, articulated at 16 at the rear of nozzle 9, is integral with an essentially radial finger 15*a*, capable at the end of its stopping travel and at the end of its starting travel, to come in contact with end faces 35 and 36 respectively of body 14. Thus, at the end of its stopping travel and before locking, finger 15*a* encounters stop 35, forcing the flap to pivot in a direction causing it to block the rear of nozzle 9, while at the end of its starting travel, stop 36 forces this finger to pivot in the opposite direction, bringing flap 15 into the open position and completely releasing the rear of nozzle 9, in preparation for the arrival of the vacuum flow.

Figure 8:
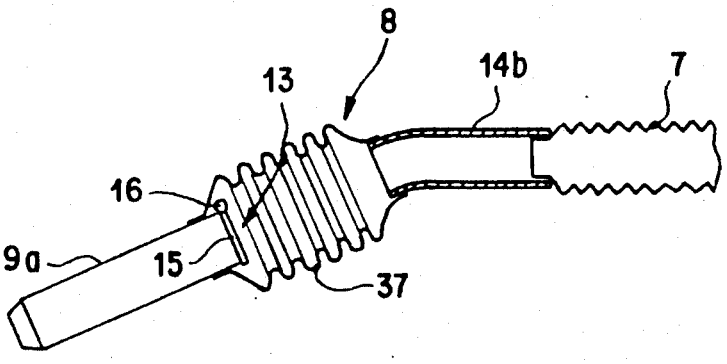
FIGS. 8, 9 and 10 are partial side views in cross section showing three other embodiments of the handle.

In the embodiment shown in FIG. 8, handle 8 is composed of a forward nozzle 9*a* with a flap 15 articulated at 16, a rear body 14*b* connected to hose 7, and a central part 37 in the form of a bellows, and made of material less rigid than those of which the other two parts are composed.

With this type of handle, displacement of nozzle 9*a* in the direction of handle rear 14*b* causes deformation of bellows 37, triggering a pressure pulse that acts on control means 23 disposed in power unit 1. As in the embodiment described with reference to FIG. 1, as soon as the hose has been traversed by a vacuum flow, flap 15 rises, permitting this vacuum to pass through nozzle 9*a* and create suction.

Figure 9:
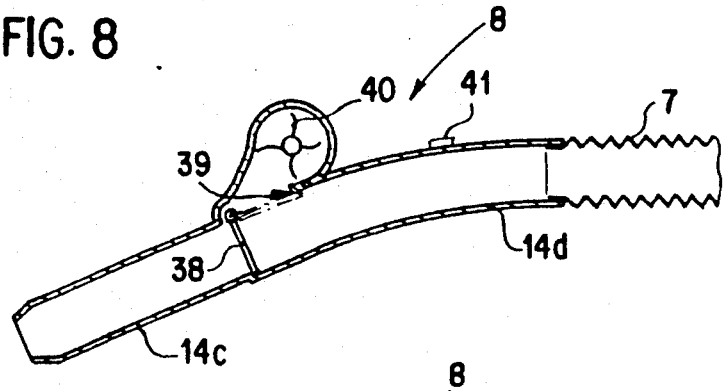

In the embodiment shown in FIG. 9, handle 8 is monolithic and comprises a forward part 14*c* blocked by an articulated flap 38, and a rear part 14*d*. The latter communicates with hose 7 and, near portion 14*c*, with outlet 39 of a turbine 40 having an independent power supply and triggered by button 41 mounted on the handle. When hose 7 is connected to a wall valve, the power unit is started by causing turbine 40 to begin rotating for a time sufficient to generate a pressure pulse in part 14*d* of the handle. As in the previous embodiments, as soon as the power unit starts, the vacuum causes flap 38 to rise, said flap, in this particular case, blocking orifice 39 at the outlet of turbine 40 to prevent the turbine from being contaminated by dust.

In a variation, the turbine is replaced by a bulb, a bellows, or other equivalent means capable, under manual pressure, of sending a pneumatic pressure pulse into the handle.

Figure 10:
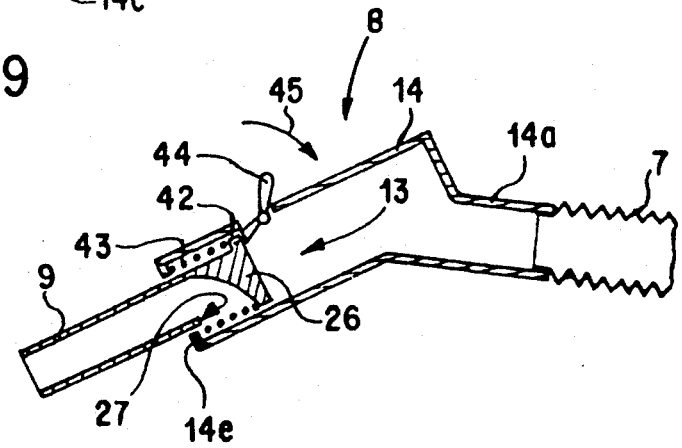

The embodiment shown in FIG. 10 differs from that shown in FIGS. 3 and 4 in the shape of the means for locking piston 13 in the stop position. Plug 26 forming piston 13 and provided at the end of nozzle 9 is flared at 42 to constitute a contact face for a compression spring 43 interposed between said plug and forward end 14*e* of the body of handle 14. A movable stop 44, constituted for example by an articulated lever, locks piston 26 in the stop position in which, as shown in FIG. 10, it compresses spring 43. To start the system, movable stop 44 need only be moved in the direction of arrow 45 to free piston 26 and allow spring 43 to push said piston inside body 14, creating a powerful pneumatic pressure pulse. At the end of its travel, piston 26 comes to rest against the rear face of housing 14, causing opening 27 juxtaposed therewith to coincide with connector 14*a*.

Moving nozzle 9 in the opposite direction relative to handle 14 locks the nozzle in the stop position, blocking the tube and interrupting the power to electric motor 3 of power unit 1.

FIG. 5 shows an embodiment of means disposed at the power unit to open and close the electrical power circuit to electric motor 3. In this drawing, 51 and 52 designate the line voltage leads, 53 and 54 are the power leads for electric motor 3, and 55 and 56 are the control circuit leads. Pressure sensor 20 cooperates with a microcontact 57 connected to circuit 55, 56 to control the power to a trip switch 58 connected in power circuit 53 of motor 3. A contact 59 is also wired into circuit 56, 55, said contact 59 being operable by a device 60 to detect the absence of a flow in the network of tubes 6, 5.

In the embodiment shown in FIG. 5, this device is composed of a cylindrical body 61 in the shape of a bell whose bottom communicates by a calibrated hole 62 with the interior of housing 2 of the power unit. A handle 63 is slidably mounted with a seal in body 61. It comprises an internal axial bore 64 accommodating a return spring 65 operating in compression and fitted between the handle and body 61. Finally, this handle is integral with an external shoulder with contact face 66 capable of cooperating with abovementioned contact 59.

When the system is functioning and as soon as a flow travels through hose 7 and tube system 6, handle 63 is in the position shown in FIG. 5. On the contrary, when there is no flow in the hose or in tube network 6 and the vacuum in housing 2 increases relatively, this vacuum is transmitted through hole 62 in body 61, causing displacement of the handle in the direction of arrow 67. Under the influence of this displacement, the face of stop 66 encounters contact 59, closing the electrical circuit controlling trip switch 58. The latter changes state, interrupting the power to electric motor 3.

Preferably, and to avoid inadvertent undesired stopping of the power unit, for example in the event of a vacuum tool being obstructed during normal use, the device is equipped with timer means. In the embodiment shown, these means are constituted by hole 62 whose cross section is designed to create a pressure drop that increases with time until the increase in vacuum in housing 2 is detected.

In the embodiment shown, the head of handle 63 is traversed by a channel 68 allowing the interior of cylindrical body 61 to communicate with the exterior. This channel is blocked by a flap 69 at the outlet of the handle. This arrangement allows using the handle as a control element and to stop and start the power unit. To start manually, it is merely necessary to push the handle in the direction of arrow 67. Under the influence of this displacement, the air contained in body 61 and compressed in the body by virtue of the small cross section of hole 62, can escape to the exterior through tube 68, raising flap 69. This displacement brings stop face 66 against contact 59, thus changing the position of trip switch 58, thus starting motor 3. It will be readily apparent that pushing handle 63 back changes the state of contact 59 and consequently the state of the trip switch, cutting off the power to motor 3.

In another embodiment shown in FIG. 5, absence of a flow is detected by monitoring the air pressure at the outlet of turbine 4. To this end, a flap with an elastic return 70 is articulated on the housing of the power unit and cooperates with contact 71 of a relay connected in a circuit, not shown, comprising an electronic module with a timer, and constituting a control module. In normal operation, flap 70 is raised by the pressure of the escaping air. When the flow in the tubes falls and the pressure at the outlet also falls, the flap pivots, tending to block the outlet opening and frees contact 71. This change in state of the contact causes power unit 1 to stop after a delay.

Figure 11:
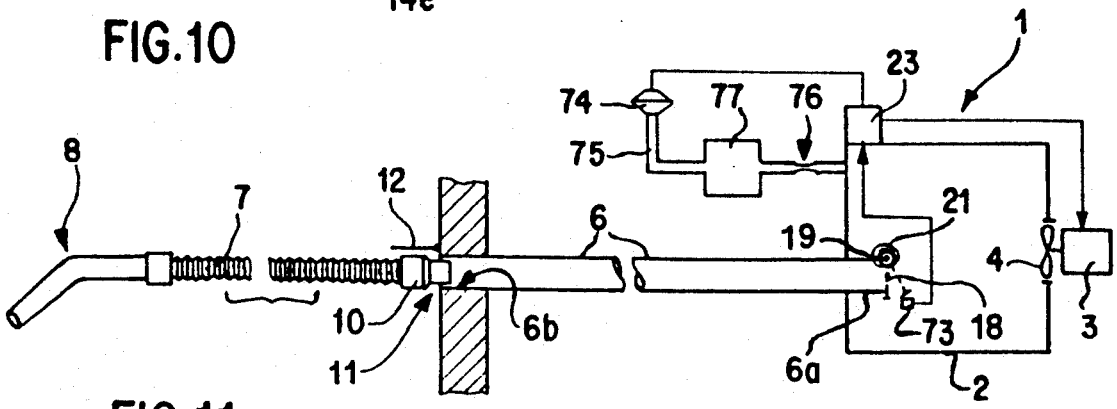
FIG. 11 is a schematic side view and cross section showing one embodiment of the means for detecting the change in vacuum.

FIG. 11 shows, in other embodiments, means of detecting the pressure wave and of detecting an increase in the vacuum.

The means for detecting the pressure pulse are composed of a motion sensor 73 of the magnetic or other type, mounted in the vicinity of the end of an articulated flap 18. Thus when the pressure pulse causes flap 18 to pivot against its return spring 21, displacement of the free end of the flap is detected by sensor 73, acting on the control module of motor 3.

A flap of this type with its sensor 73 can also be disposed on a tube branching off the downstream end 6*a* of tube 6.

The means for detecting the increase in vacuum in housing 2 are constituted by a vacuum sensor 74 electrically connected to the control circuit of motor 3. This vacuum sensor is pneumatically connected by a tube 75 to housing 2, with interposition of a part with a constriction 76 and also of an intermediate timing chamber 77.

Thus, when the vacuum rises in housing 2, this increase is transmitted to vacuum sensor 74 with a delay that is a function of the cross section of constriction 76 and of the volume of air in chamber 77, producing the desired time delay.

The control device described above, when applied to a central vacuum system, can also be applied with either or both of its start and stop functions to vacuum cleaners of the portable, canister, or other type, to mechanical ventilation systems, and to fume hoods. In the latter applications, the means for generating the pressure wave and those for interrupting the vacuum flow are not located in the handle of a vacuum hose, but in a tubular body connected or connectable to a socket mounted on a tube or network of tubes upstream of the vacuum housing.

I claim:

1. Device for remote control of a vacuum comprising a housing, a motorized vacuum turbine connected pneumatically to an outlet of the housing for creating a vacuum in the housing, and at least one tube with a downstream end which terminates in the housing, means connected to an upstream end of the tube for generating a single pneumatic pressure pulse in the direction of said downstream end, said downstream end being associated with means for detecting the pneumatic pressure pulse and acting on an electric motor of the vacuum turbine to start the motor, the pneumatic pressure pulse being conducted by the tube from said upstream end to said downstream end, said downstream end being provided with a shutoff flap normally held in the closed position and capable of opening under the influence of vacuum created in housing.

2. Device according to claim 1, further comprising means to cut off a vacuum flow in said tube to said housing and thus to shut off the motor, and detection means located near said housing to detect absence of vacuum flow in the tube and acting, with a time delay, to open the electric circuit powering said motor.

3. Device according to claim 2, wherein said detection means reacts to an increase in vacuum and said housing.

4. Device according to claim 3, wherein said detection means comprises a tubular body external to said housing but in fluid communication with said housing and a handle, said handle being mounted with a return spring slidably and sealably in said tubular body, said comprising at least one stop face capable of actuating, at the end of its travel and on encountering said spring, a contact wired in said electric circuit.

5. Device according to claim 4, wherein said fluid communication between said tubular body and said housing is provided by a calibrated constricting orifice creating a flow loss, and said device further comprises means for timing equalization of vacuum in said housing and said tubular body and displacement of said handle.

6. Device according to claim 4, wherein said handle constitutes an element for starting the motor and comprises an internal duct with an external unidirectional blocking valve capable of causing the interior of said tubular body to communicate with the exterior of said tubular body, with said electric circuit being provided with a trip switch electrically connected to a first contact cooperating with said handle and to a second contact cooperating with said means for detecting the pneumatic pressure wave.

7. Device according to claim 3, wherein said detection means comprises a vacuum sensor electrically connected to said electric circuit and pneumatically connected to an intermediate timing chamber, said intermediate timing chamber being connected to said housing with interposition of a calibrated constriction.

8. Device according to claim 2, wherein said detection means reacts to variation in air pressure at an outlet of said turbine and comprises an articulated flap located in the path of air emerging from said housing and cooperating with a contact of a time delay relay wired into said electric circuit .

9. Device according to claim 1, further comprising an independent hose having one end connectable to said tube and another end provided with a handle with a forward nozzle for mounting tools and vacuum accessories, and said means for generating a pressure pulse being disposed in the handle.

10. Device according to claim 3, wherein said means for generating the pressure wave comprises a piston slidably mounted in a body of said handle between and anterior stop position and a posterior working position, said piston being formed at the rear of said forward nozzle.

11. Device according to claim 10, wherein the rear of said forward nozzle comprises an axial plug and a radial opening, said opening coinciding with an end of said hose in said body of said handle in an operating position.

12. Device according to claim 11, wherein said body of said handle is provide with means for elastic wedge-locking, said means cooperating, at least when said nozzle is in a stop position, with a catch on said nozzle.

13. Device according to claim 10, wherein the rear of said nozzle is blocked by an articulated flap forming said piston and being capable of rising under the influence of vacuum pressure.

14. Device according to claim 13, wherein said flap is elongated, beyond its articulation, by an essentially radial finger, said finger coming in contact at the end of a starting travel and at the end of a stopping travel, with faces of stops in said handle body, causing it to move into an open position and a closed position, respectively.

15. Device according to claim 10, further comprising means for cutting off the vacuum flow and thus for shutting off said motor comprising said piston when it is in the stop position.

16. Device according to claim 9, further comprising a compression spring interposed between the rear of said nozzle and a forward end of said body of said handle, said handle body being provided with a movable stop, operable from the exterior, capable of wedging said nozzle in a stop position with said spring compressed.

17. Device according to claim 9, wherein said handle comprises a handle body, a forward nozzle whose rear is associated with an articulated flap capable of rising under the influence of a vacuum, and a bellows connecting said handle body to said forward nozzle.

18. Device according to claim 9, wherein said handle is monolithic and comprising a forward part blocked by an articulated flap capable of rising under the influence of a vacuum, a second turbine, and a rear part in which an outlet of said second turbine terminates, said second turbine being independently powered and controlled by means on the handle and being capable of generating said pressure pulse.

19. Device according to claim 9, further comprising means for cutting off the vacuum flow and thus for shutting off said motor.

20. Device according to claim 14, wherein the means for cutting off the vacuum flow comprises an articulated flap disposed in said handle and connected to manual actuating means.

21. Device according to claim 1, wherein said means for detecting the pneumatic pressure pulse comprises a pressure sensor connected pneumatically by a channel to said tube and electrically to a circuit for controlling the power to said motor.

22. Device according to claim 1, wherein said means for detecting the pneumatic pressure pulse comprises a movement sensor for detecting displacement of said shutoff flap and connected to a circuit for controlling the power to said motor.

23. Device for remote control of a vacuum or system, comprising:

a vacuum source;

at least one tube having a main working lumen having first and second ends, said first end being in fluid communication with said vacuum source;

means associated with said second end for generating a single pneumatic pressure pulse in said main working lumen; and means for detecting said pressure pulse and activating said vacuum source in response to detection of said pressure pulse.

24. Device according to claim 23, further comprising:

means for cutting off air flow through said main working lumen; and means for detecting cessation of air flow through said main working lumen and deactivating said vacuum source in response to detection of said cessation of air flow.

* * * * *

UNITED STATES PATENT AND TRADEMARK OFFICE

CERTIFICATE OF CORRECTION

PATENT NO. : 5,191,673

DATED : March 9, 1993

INVENTOR(S) : Patrick Damizet

It is certified that error appears in the above-identified patent and that said Letters Patent is hereby corrected as shown below:

In the drawings, Sheet 1, Fig. 1, the reference numeral "3" at the left side of the figure should be changed to "8".

Signed and Sealed this

Thirtieth Day of November, 1993

Bruce Lehman

*Attest:*

BRUCE LEHMAN

*Attesting Officer*

*Commissioner of Patents and Trademarks*